US006443590B1

(12) United States Patent
Lovitt

(10) Patent No.: US 6,443,590 B1
(45) **Date of Patent: *Sep. 3, 2002**

(54) ARTICLE WITH ANIMATED DISPLAY

(75) Inventor: Bert Lovitt, Pacific Palisades, CA (US)

(73) Assignee: Lovitt Films, Inc., Pacific Palisades, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/619,126

(22) Filed: Jul. 18, 2000

Related U.S. Application Data

(63) Continuation-in-part of application No. 09/287,520, filed on Apr. 7, 1999, now Pat. No. 6,112,437.

(51) Int. Cl.[7] ..... F21V 9/16

(52) U.S. Cl. ..... 362/103; 362/84; 362/108; 362/806; 362/118; 36/137; 352/100

(58) Field of Search ..... 362/84, 103, 104, 362/106, 108, 118, 806; 40/502; 36/136, 137; 352/100

(56) References Cited

U.S. PATENT DOCUMENTS

| | | | |
|---|---|---|---|
| 742,632 A | 10/1903 | Hadden | |
| 917,587 A | 4/1909 | Good | |
| 2,299,731 A | 10/1942 | Arendt | |
| 2,557,663 A | 6/1951 | Knode | |
| 3,604,707 A | 9/1971 | Hurley | |
| 3,689,131 A | 9/1972 | Klein et al. | |
| 3,704,064 A | 11/1972 | Sollogoub et al. | |
| 3,745,678 A | 7/1973 | Thomassen | |
| 3,770,271 A | 11/1973 | Kim | |
| 3,951,529 A | 4/1976 | Gandia | |
| 4,130,951 A | 12/1978 | Powell | |
| 4,308,572 A | 12/1981 | Davidson et al. | |
| 4,383,742 A | 5/1983 | Brachet et al. | |
| 4,712,319 A | 12/1987 | Goria | |
| 4,848,009 A | 7/1989 | Rodgers | |
| 5,359,790 A | 11/1994 | Iverson et al. | |
| 5,367,795 A | 11/1994 | Iverson et al. | |
| 5,438,488 A | 8/1995 | Dion | |
| 5,457,900 A | 10/1995 | Roy | |
| 5,469,342 A | 11/1995 | Chien | |
| 5,572,817 A | 11/1996 | Chien | |
| 5,709,464 A | 1/1998 | Tseng | |
| 5,743,616 A | 4/1998 | Giuliano et al. | |
| 5,746,501 A | 5/1998 | Chien | |
| 5,812,063 A | 9/1998 | Weng et al. | |
| 5,813,148 A | 9/1998 | Guerra | |
| 5,865,523 A | 2/1999 | Chien | |
| 6,016,183 A | 1/2000 | Yamamoto | |
| 6,112,437 A * | 9/2000 | Lovitt | 362/103 X |

FOREIGN PATENT DOCUMENTS

| | | |
|---|---|---|
| WO | 94015494 | 7/1994 |

* cited by examiner

*Primary Examiner*—Stephen Husar
(74) *Attorney, Agent, or Firm*—Blakely, Sokoloff, Taylor & Zafman LLP

(57) ABSTRACT

A lateral animation display sequentially illuminates individual images of an animated sequence. The display may be carried on a useful article, such as an item of wearing apparel or the like. An array of light sources illuminates a corresponding array of image frames depicting a stop-action sequence, such as stop-action images of a person running. An optional array of baffles confines light from each of the light sources to a corresponding one of the image frames. The individual light sources are sequentially activated so as to sequentially illuminate the corresponding image frames and thereby present an animated display of the stop-action sequence. A semi-transparent layer over the image frames obscures the images except when illuminated by the corresponding light source.

11 Claims, 2 Drawing Sheets

ARTICLE WITH ANIMATED DISPLAY

RELATED APPLICATION

This is a continuation-in-part of co-pending application Ser. No. 09/287,520 filed Apr. 7, 1999 now U.S. Pat. No. 6,112,437.

BACKGROUND OF THE INVENTION

1. Field of the Invention

The present invention relates generally to the field of animated displays. More particularly, the invention comprises methods and apparatus for incorporating an animated display into a variety of useful articles such as shoes and other items of apparel, watchbands, pens, etc.

2. Prior Art

Shoes with flashing lights have recently become popular, particular with children. Such shoes are shown, for example, in U.S. Pat. No. 4,848,009 issued to Rodgers. These shoes typically have one or a few light emitting diodes (LEDs) that flash intermittently as the wearer of the shoe walks or runs. A somewhat more elaborate device is disclosed in U.S. Pat. No. 5,457,900 issued to Roy. In this patent, a shoe includes an array of LEDs that are switched on and off in a non-random fashion so as to display a two-dimensional graphic image when the shoe is moved through a step.

Animation is an art form that can be traced back to ancient Greece. Animation relies on the persistence of vision of the human eye to integrate a sequence of discrete images so that they are perceived to show continuous movement. Animated motion pictures and the like display successive images at the same physical location. The display of successive images in an animated sequence at laterally displaced locations has been proposed for use with moving vehicles. Displays of this type are disclosed in U.S. Pat. No. 917,587 issued to Good, U.S. Pat. No. 2,299,731 issued to Arendt, U.S. Pat. No. 3,704,064 issued to Sollogoub, et al., U.S. Pat. No. 3,951,529 issued to Gandia and U.S. Pat. No. 4,383,742 issued to Brachet, et al. In these systems, successive images are illuminated at a rate determined by the speed of the moving vehicle so that an observer on the vehicle sees an apparently stationary animated display.

SUMMARY OF THE INVENTION

The present invention comprises a lateral animation display. "Lateral animation" refers to an animation technique whereby individual images in an animated sequence are displayed sequentially at laterally displaced locations. The display may be carried on a useful article, such as an item of wearing apparel or the like.

In a specific embodiment, the present invention provides a shoe with an integral animated display. An array of light sources is disposed within the shoe. A corresponding array of image frames depicts a stop-action sequence, such as stop-action images of a person running. An optional array of baffles confines light from each of the light sources to a corresponding one of the image frames. The individual light sources are sequentially activated so as to sequentially illuminate the corresponding image frames and thereby present an animated display of the stop-action sequence.

Other embodiments of the invention incorporate lateral animation displays with a watchband, a pen, a backpack strap and similar useful articles.

DETAILED DESCRIPTION OF THE INVENTION

In the following description, for purposes of explanation and not limitation, specific details are set forth in order to provide a thorough understanding of the present invention. However, it will be apparent to one skilled in the art that the present invention may be practiced in other embodiments that depart from these specific details. In other instances, detailed descriptions of well-known methods and devices are omitted so as to not obscure the description of the present invention with unnecessary detail.

Figure 1:
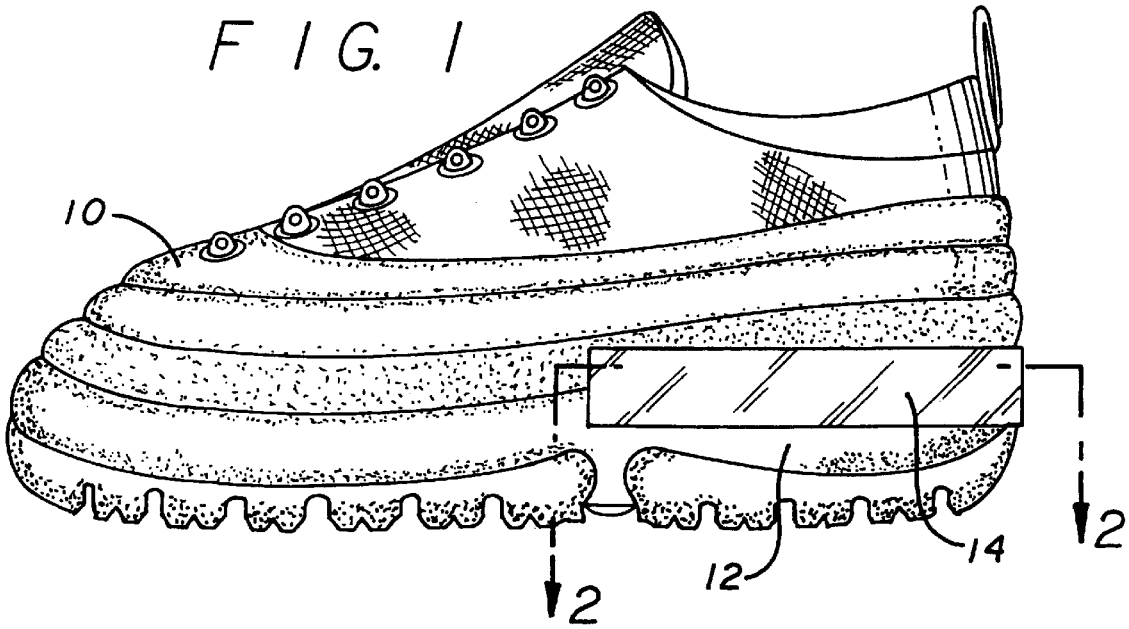
FIG. 1 is a side elevation view of a shoe incorporating the present invention.

FIG. 1 illustrates an embodiment of the present invention in the form of an athletic shoe 10. The shoe includes a heel portion 12 with a display panel 14 wrapping around the heel portion.

Figure 2:
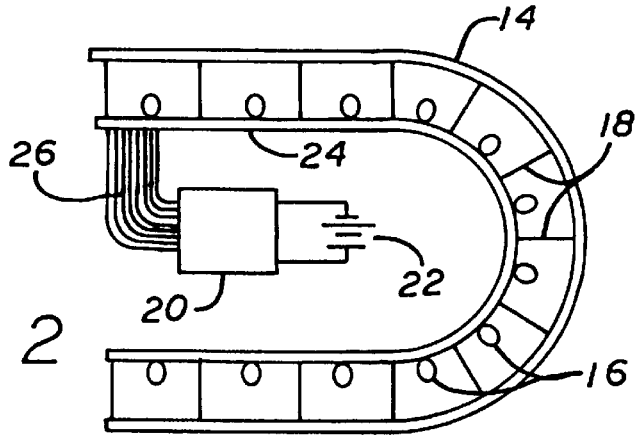
FIG. 2 is a cross-sectional view of the shoe shown in FIG. 1 taken through line 2—2.

FIG. 2 is a cross-sectional view of the heel portion 12 of shoe 10. Display panel 14 wraps around the heel portion 12 as described above. An array of light sources 16 is disposed within the heel. The light sources may be light emitting diodes (LEDs), although other light sources are within the scope of the invention. For example, the light sources could also be incandescent bulbs. Furthermore, display panel 14 could be constructed as an electro-luminescent panel, in which case the light sources would be integrated with the panel itself. The individual light sources 16 are controlled by electronics module 20, which receives power from battery 22. Provisions may be made in the sole of shoe 10 for convenient replacement of battery 22.

Light sources 16 are preferably spaced apart from display panel 14. An array of baffles 18 confine the light emitted by each of the light sources to a single frame of display panel 14. Such baffling is necessary to prevent light from one of the light sources 16 from "bleeding through" adjacent frames of display panel 14. In certain embodiments of the invention, baffles are not necessary. This is particularly true if display panel 14 is constructed as an electro-luminescent panel. Furthermore, if the light sources 16 are spaced very close to display panel 14, there is less likelihood of "bleed through" and baffles may not be necessary.

The light sources 16 are mounted on a substrate 24. The substrate 24 is preferably a flexible printed circuit material which is patterned for distribution of electrical energy to the individual light sources 16. Circuit module 20 may be mounted directly to substrate 24 or may be connected thereto by an electrical cable 26.

Figure 3:
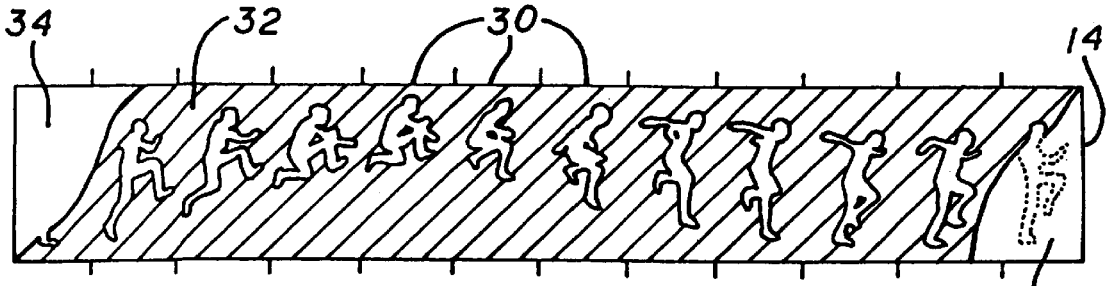
FIG. 3 is a detailed view of a display panel according to the present invention.

Referring to FIG. 3, details of display panel 14 are shown. As mentioned above, display panel 14 comprises a series of individual frames 30. Each of the frames carries an image that is illuminated by a corresponding light source 16. The light sources 16 are controlled to sequentially illuminate the frames 30 and thereby present an animated display. Alternatively, display panel 14 may be constructed as an electro-luminescent panel, in which case each of the images would be self-illuminated.

In the example shown in FIG. 3, the images of frames 30 comprise a stop-action sequence depicting a person running and jumping. Other sequences of images could be used. For example, frames 30 could comprise individual words of a slogan or a sentence. Although the invention is illustrated as applied to certain useful articles, it will be appreciated that the invention may also be embodied in signage, such as might be used, for example, in point-of-sale displays.

The light sources 16 are sequentially activated by circuit module 20 as described above. Each of the light sources is turned on for a predetermined period of time and then the adjacent light source is activated until each of the light sources in the array has been activated in turn. The timing of the light sources may be dependent upon the nature of the images. For example, an animated display of a person running and/or jumping is best viewed at about 5 to 6 frames per second. A slower frame rate may be desirable if the display frames comprise the words of a slogan or sentence. The most pleasing results have been observed when each of the light sources is extinguished at approximately the same time as the adjacent light source is activated. However, for certain displays, it may be desirable to overlap the activation of adjacent light sources.

In addition to the timing of the individual light sources, circuit module 20 also controls display of the overall animation sequence. A single sequence of images may be presented each time the device is triggered or the sequence may be displayed for a predetermined number of cycles before going into a "sleep" mode. Further triggers would be ignored for a predetermined period of time until expiration of the sleep mode.

The display sequence can be triggered by any suitable means. As with many prior art shoes that incorporate LEDs, shoe 10 may include a motion switch that initiates presentation of the animated display each time the shoe wearer takes a step. Alternatively, shoe 10 may incorporate a switch that requires a specific action by the wearer to trigger the animated display. All of the various alternatives for triggering presentation of the animated display are within the scope of this invention.

Display panel 14 includes an image layer 32, which may be a strip of film or other suitable material containing the sequence of images. Image layer 32 may be opaque with transparent images, as shown in FIG. 3, or may be transparent with opaque images. The transparent areas of image layer 32 may be either clear or colored. A diffuser layer 34 may be placed between the light sources and the image layer to provide more uniform illumination of the image frames. Diffuser layer 34 may be a separate layer of material behind image layer 32 or may be a coating or surface treatment applied directly to image layer 32. In lieu of a diffuser layer, light sources 16 may be selected or treated to provide a diffuse light source. For example, conventional LEDs may be frosted or lightly sanded to provide a more diffuse source of illumination.

Image layer 32 is preferably covered with a semi-transparent layer 36 which obscures the images in frames 30 except when they are illuminated by light sources 16. Layer 36 may be a separate layer of material placed over image layer 32 or may be a coating applied directly to image layer 32.

It will be recognized that there are numerous other applications for the lateral animation technique of the present invention. Animated displays similar to that previously described may be incorporated into a variety of articles, including wearing apparel, watchbands, pens, etc.

Figure 4:
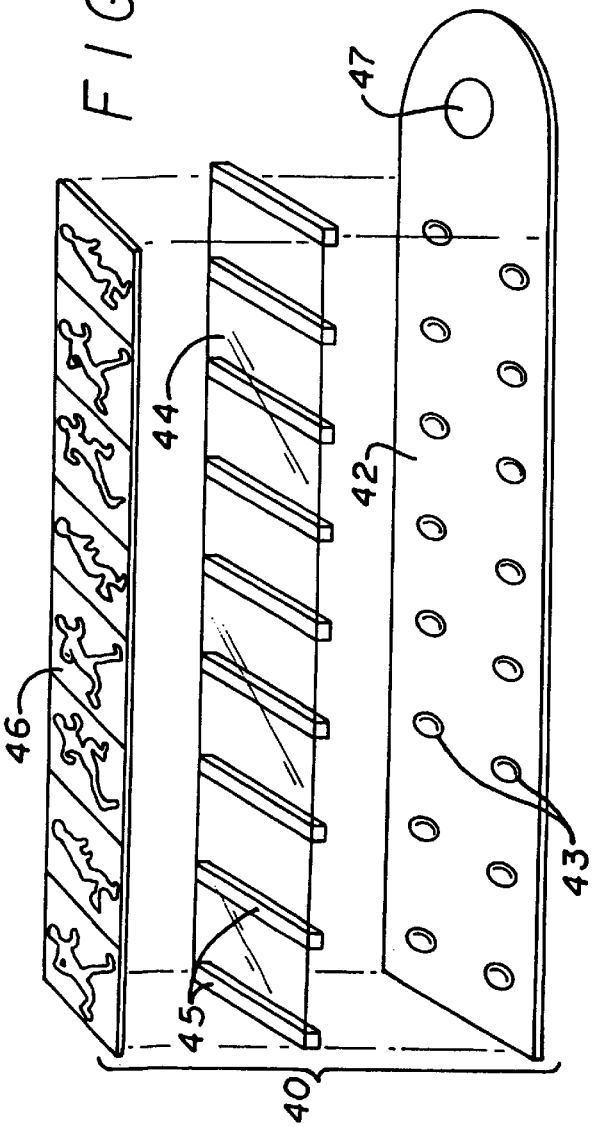
FIG. 4 illustrates a watchband constructed in accordance with the present invention.

FIG. 4 illustrates a flexible animated display panel 40 suitable for use on a watchband. The display panel comprises a flexible circuit board 42 having an array of LEDs 43. A circuit module and battery may be conveniently mounted on the lower surface of circuit board 42. A control switch 47 is provided for activation of the animated display. A sheet 44 of translucent plastic material with opaque light barriers 45 attached thereto is placed over the circuit board 42. A film strip 46 or similar image layer is placed over sheet 44. Alternatively, the images may be placed on a relatively thick (approximately 1/16 inch) translucent substrate, in which case sheet 44 and light barriers 45 may be dispensed with. As with the previously described embodiment, a further sheet of semi-transparent material (not shown) is preferably placed over film strip 46. Using this method of construction, a very thin and flexible display panel may be produced.

Figure 5A:
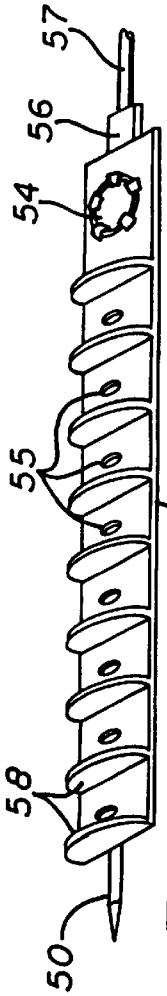
FIGS. 5*a* and 5*b* illustrate a pen constructed in accordance with the present invention.
Figure 5B:
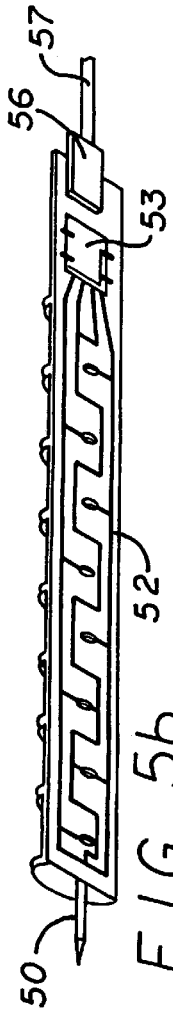

FIGS. 5*a* and 5*b* illustrate a pen 50 adapted to include an animated display. A circuit board structure 52 is disposed within the body of the pen. Circuit module 53, battery 54 and LEDs 55 are attached directly to the circuit board. A switch 56 having a push-button control 57 is provided to activate the animated display. Light baffles 58 may be separately attached to circuit board 52, but are preferably molded integrally therewith. An image layer and a semi-transparent layer are then placed over the curved surfaces of light baffles 58 in substantially the same manner as the previously described embodiments.

Figure 6:
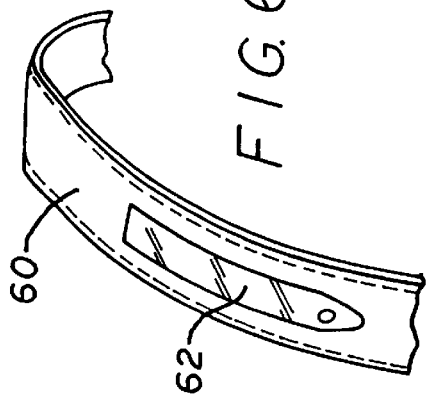
FIG. 6 illustrates a backpack strap constructed in accordance with the present invention.

FIG. 6 illustrates a backpack strap 60 having an animated display panel 62. Display panel 62 may be constructed in substantially the same manner as described above in connection with FIG. 4. In like fashion, animated display panels may be included on hats, belts, jackets, shirts, desk accessories, coffee mugs and picture frames, to name only a few examples.

It will be recognized that the above described invention may be embodied in other specific forms without departing from the spirit or essential characteristics of the disclosure. Thus, it is understood that the invention is not to be limited by the foregoing illustrative details, but rather is to be defined by the appended clams.

What is claimed is:

1. An illuminated animated display comprising:

a unitary display panel having a series of adjacent image frames having front and rear surfaces depicting a stop-action sequence;

an array of light sources disposed on a unitary substrate, each light source disposed behind the rear surface of a corresponding image frame to illuminate said corresponding image frame;

means for sequentially actuating each of the light sources to sequentially illuminate the corresponding image frame, thereby presenting an animated display of the stop action sequence;

a semi-transparent image masking layer over the front surface of the image frames, said masking layer being sufficiently opaque such that all image frames of the stop-action sequence are obscured from view except when illuminated by the corresponding light source.

2. The apparatus of claim 1 wherein the display is disposed on a shoe.

3. The apparatus of claim 1 wherein the display is disposed on an item of wearing apparel.

4. The apparatus of claim 1 wherein the display is disposed on a watchband.

5. The apparatus of claim 1 wherein the display is disposed on a writing instrument.

6. An illuminated animated display comprising:

an array of image frames having front and rear surfaces depicting a stop-action sequence;

an array of light sources, each light source disposed behind the rear surface of the image frames to illuminate a corresponding image frame;

means for sequentially actuating each of the light sources to sequentially illuminate the corresponding image frame, thereby presenting an animated display of the stop action sequence;

a semi-transparent image masking layer over the front surface of the image frames, said masking layer being sufficiently opaque such that all image frames of the stop-action sequence are obscured from view except when illuminated by the corresponding light source;

wherein the display is disposed on a backpack strap.

7. The apparatus of claim 1 wherein the light sources are electro-luminescent.

8. The apparatus of claim 1 wherein the unitary display panel is flexible.

9. The apparatus of claim 1 wherein the unitary substrate comprises a flexible printed circuit board.

10. The apparatus of claim 1 wherein the series of adjacent image frames comprises a unitary film strip.

11. The apparatus of claim 1 wherein the display is disposed on a backpack strap.

* * * * *